US007114213B2

(12) United States Patent
DeRoma

(10) Patent No.: US 7,114,213 B2
(45) Date of Patent: Oct. 3, 2006

(54) FREE-STANDING LINT ROLLER WITH CASE

(76) Inventor: Flavio DeRoma, 400 Corporate Dr., Blauvelt, NY (US) 10913

( * ) Notice: Subject to any disclaimer, the term of this patent is extended or adjusted under 35 U.S.C. 154(b) by 0 days.

(21) Appl. No.: 10/911,829

(22) Filed: Aug. 5, 2004

(65) Prior Publication Data

US 2006/0026782 A1 Feb. 9, 2006

(51) Int. Cl.
*A47L 25/00* (2006.01)

(52) U.S. Cl. ..... 15/104.2

(58) Field of Classification Search ..... 15/104.2
See application file for complete search history.

(56) References Cited

U.S. PATENT DOCUMENTS 2,423,962 A * 7/1947 Clark et al. ..... 15/104.2
2,542,774 A * 2/1951 Hutchinson ..... 15/104.2
3,381,325 A * 5/1968 Reineman ..... 15/104.2
3,421,170 A * 1/1969 Thomas, Jr. ..... 15/104.2
3,623,179 A * 11/1971 Roth ..... 15/104.1
4,361,923 A * 12/1982 McKay ..... 15/14.2
4,399,579 A 8/1983 McKay
4,557,011 A * 12/1985 Sartori ..... 15/104.2
4,570,280 A * 2/1986 Roth ..... 15/104.2
4,727,616 A 3/1988 Kucera et al.
4,979,257 A * 12/1990 Heneveld ..... 15/104.2
5,027,465 A 7/1991 McKay
D342,610 S 12/1993 Stetson et al.
5,333,341 A * 8/1994 Heneveld ..... 15/104.2
6,865,765 B1 * 3/2005 Aalbers ..... 15/104.2
2003/0089632 A1 * 5/2003 Jessen et al. ..... 206/389
2003/0209565 A1 * 11/2003 McKay ..... 222/192

* cited by examiner

*Primary Examiner*—Randall Chin
(74) *Attorney, Agent, or Firm*—Stephen E. Feldman

(57) ABSTRACT

A lint roller with a case is provided. The lint roller has a handle and a roller support section. A case is provided as well to fit over the support section when the lint roller is not in use. The handle has a lip at one end that is the same shape and thickness as an edge of the case. The case provides protection for the adhesive roller to prevent it from unintentionally sticking to anything and means to stand the lint roller up, taking up less storage space.

9 Claims, 2 Drawing Sheets

Fig. 1
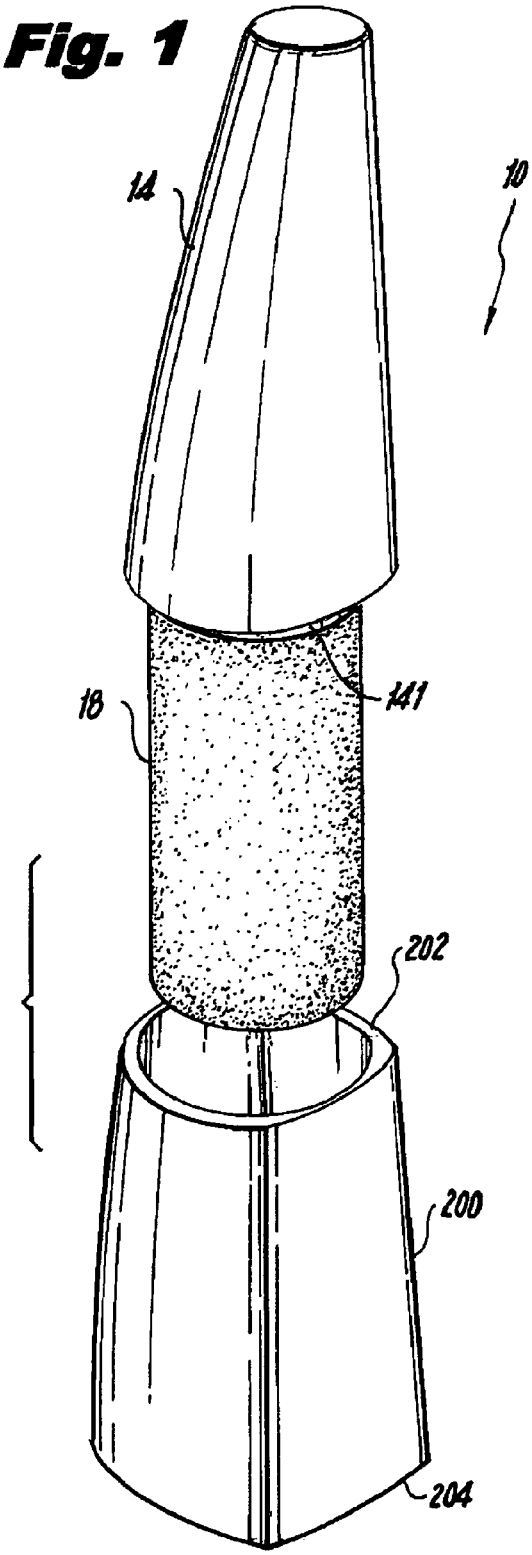
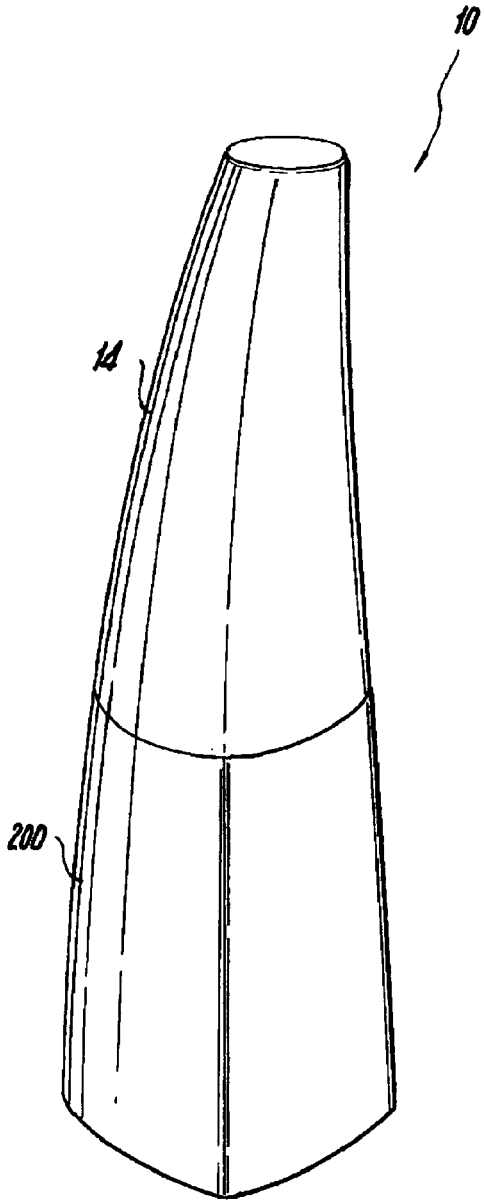
Fig. 2

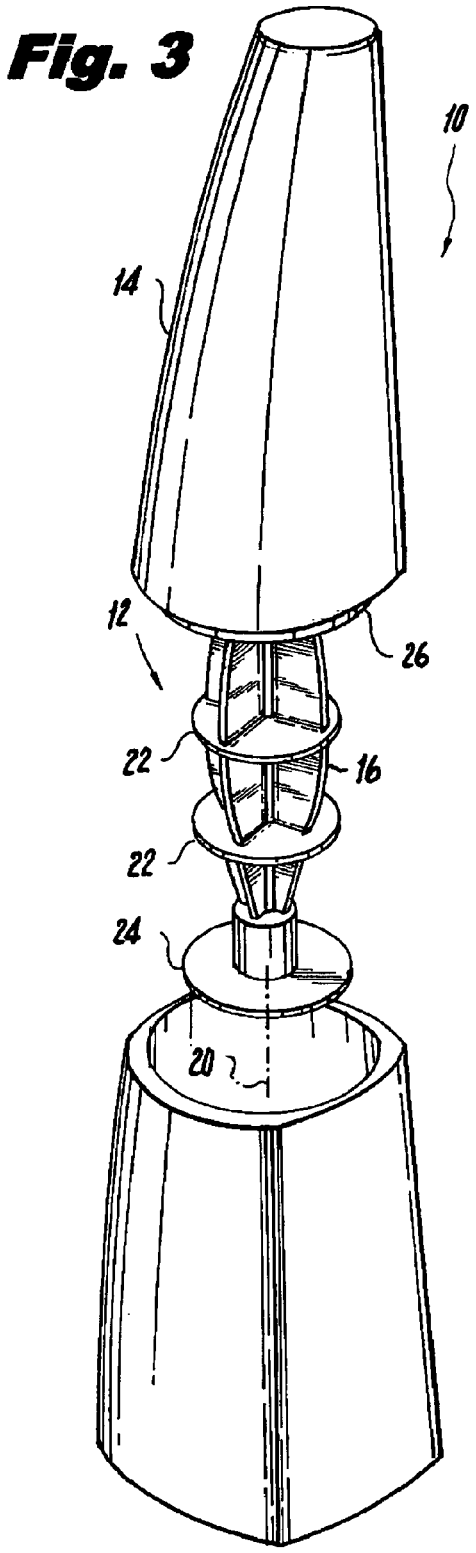
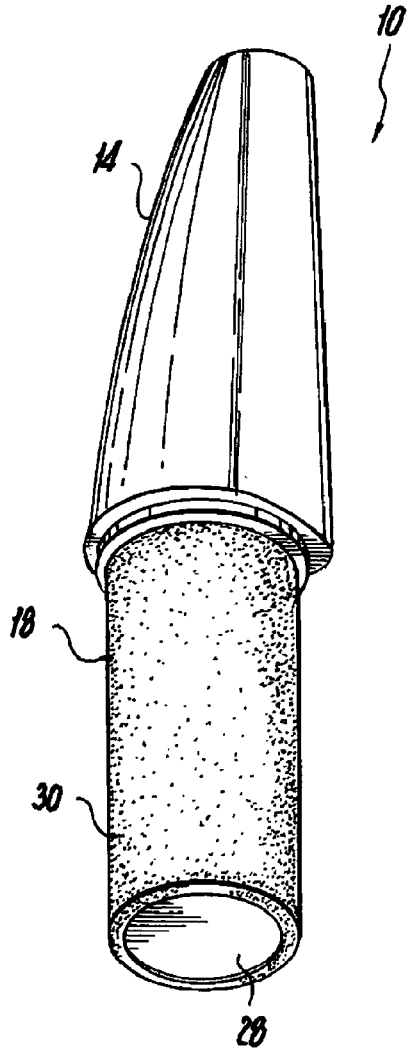
Fig. 4

FREE-STANDING LINT ROLLER WITH CASE

FIELD OF THE INVENTION

The present invention deals with lint rollers and more specifically, a free-standing lint roller with a case.

BACKGROUND OF THE INVENTION

Lint rollers are well known for use in removing micro-debris such as lint and pet hair, from furniture, linens and clothes. In use, such lint rollers are typically coated with adhesive masking tape sheets wound around a cylindrical core that rotates. When the adhesive tape becomes contaminated with micro-debris, the contaminated adhesive sheet is then peeled off and discarded, readying a subsequent adhesive sheet for more use.

There are several known types and styles of lint rollers. Examples of such prior art devices are McKay, U.S. Pat. No. 5,027,465 band U.S. Pat. No. 4,399,579, Kucera, U.S. Pat. No. 4,727,616 and Stetson U.S. Pat. No. D342,610. These previously known lint roller assemblies typically comprise a handle secured to a cylindrical lint roller support. A tubular cylindrical adhesive lint roller is then removably mounted to the support such that the adhesive roller is rotatable relative to the handle.

Storing lint rollers when not in use presents a problem because the past, prior art designs do not provide a cover for the adhesive section. In addition, there are no means for storing the roller in an upright position. So, the adhesive part sticks to the surface on which the roller is resting, and usually to any surrounding objects it may bump into when being moved. Trying to stand a prior art design on its end usually ends up with the roller falling over, sticking to a nearby object, and then bringing both the roller and the object it is stuck to, off the shelf upon which it rests. If it doesn't fall off the shelf, it will act as a domino and knock everything in the surrounding area over.

SUMMARY OF THE INVENTION

A lint roller with a case is provided. The lint roller has a handle and a roller support section. A case is provided as well to fit over the support section when the lint roller is not in use. The handle has a lip at one end that is the same shape and thickness as an edge of the case. The case provides protection for the adhesive roller to prevent it from unintentionally sticking to anything and means to stand the lint roller up, taking up less storage space.

In further detail, the lint roller comprises a handle, a roller support section in substantial axial alignment with, and attached to, the handle; and, a case. The case is arranged to fit onto the handle and over the roller support section.

In accordance with further aspects of a preferred embodiment, the lint roller further comprises an adhesive roller that may be a number of adhesive sheets wound on a core, or a flexible washable plastic substrate of polyvinyl.

BRIEF DESCRIPTION OF THE DRAWINGS

FIG. 1 shows a lint roller and case in accordance with an embodiment of the present invention.

FIG. 2 shows the lint roller of FIG. 1 with the case attached thereto.

FIG. 3 shows a lint roller in accordance with an embodiment of the present invention without an adhesive roll.

FIG. 4 shows the lint roller of FIG. 3 with an adhesive roll attached.

DETAILED DESCRIPTION

FIGS. 1–2 shows a lint roller in accordance with an embodiment of the present invention, generally indicated by reference numeral 10. The lint roller is generally cylindrical in shape, with a substantially conical-shaped, tapered handle 14. An adhesive cylinder, or roller 18 is rolled along and against a surface to pick up dirt and debris. A case or cover 200, provides protection for the adhesive roller section 18 from sticking to anything as well as providing means to stand the roller 10 up, as shown in FIG. 2.

The case 200 is constructed and arranged to fit over the roller 18 so that the handle 14 rests on the case 200. In this particular embodiment, the case 200 slides over the roller 18 and onto the handle 12.

A lip 141 on the end of the handle 14 fits onto the top edge 202 of the case 200 for a secure and flush fit (FIG. 2). So, the shape and thickness of the top edge 202 of the case 200 should be the same shape and thickness as the lip 141 of the handle 14. In other words, the shape and thickness of lip 141 should be the same as the cross-section of the top edge 202 of the case 200.

In addition, the case 200 has a flat bottom 204, allowing it to stand up freely, with no other support. Preferably, the bottom 204 has a larger cross-section than the top edge 202. In this way, the case 200 can receive and hold the roller 18 and handle 14 in a vertical position so that the roller 10 takes up less storage space overall.

In further detail and in reference to FIGS. 1–3, an exploded view of the preferred embodiment of the lint roller assembly 10 of the present invention is there shown and comprises an elongated housing 12 having both a handle 14 and a lint roller support section 16. A tubular and cylindrical lint roller 18 is slidably received over the lint roller support section 16 and retained to the lint roller support section 16 in a manner subsequently described in greater detail.

The lint roller support section 16 is generally cylindrical in shape and has a predetermined axial or longitudinal length 20. The support section 16 has a number of circumferentially extending rings 22 that define a circumference and diameter for a contact area that engages and supports the interior of the lint roller section 18.

With reference now particularly to FIG. 4, the lint roller 18 includes a tubular and cylindrical core 28 having an adhesive roll 30 wound about the core 28. This adhesive roll 30 is conventional in construction and includes a backer sheet coated with an adhesive on one side. The adhesive roll 30 may be either continuous or perforated into single sheets wherein the width of each sheet substantially equals the circumference of the adhesive roll 30.

The longitudinal length of the core 28 is substantially the same or slightly less than the longitudinal length of the support section 16. Furthermore, the inside diameter of the core 28 is substantially the same or slightly less than the outside diameter of the lint roller support section 16 as defined by the outer surface of the rings 22.

In order to mount the lint roller 18 to the lint roller support section 16, the lint roller 18 is pushed over the lint roller support section 16. The diameter of the section 16 is sufficiently smaller than the circumference of the roller 18 interior to allow free rotation of the lint roller 18 relative to the lint roller support section 16. However, the abutment between the axial ends of the core 28 with the ends 24 and 26 of the section 16 retains the lint roller 18 on the lint roller support section 16 until the adhesive roll 30 is depleted.

In accordance with further aspects of a preferred embodiment, the cap end 24 of the support section 16 may be removable so that the adhesive roller 18 can be more easily slid on and off the support section 16. With the removable cap, the cap is removed, the old roller removed, and the new one put on.

The roller 18 is a pressure sensitive adhesive tape and can consist of a saturated release coated crepe paper, pulled out paper, flat back paper or can be fabricated utilizing a flexible washable plastic substrate of poly vinyl or other suitable washable plastic sheet material having a washable pressure sensitive adhesive coating provided on one side thereof. The adhesive coating provided on the flexible plastic substrate can also be a water base poly vinyl acetate so as to be washable so that each layer of tape can be used several times before being detached and discarded as hereinafter described.

In use, the lint remover assembly 10 is selectively rolled over the surface to be cleaned so that the outer adhesive surface of the tape roll 30 removes the lint, dust and foreign particles therefrom as they adhere thereto. After the outer surface becomes saturated through repeated use, the outer used layer can be removed. This is initially accomplished by lifting the corner of the leading edge of the tape roll 30 and pulling the used layer away from the tape roll 30 so as to expose the unused adhesive tape layer therebelow.

After the used layer is thus removed, the lint remover 10 is ready for use until the newly exposed tape layer is similarly saturated. The foregoing process is repeated until the entire tape roll is expended. A new refill tape roll is selectively installed on the roller assembly as desired.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A lint roller comprising:

a substantially conical-shaped handle, said handle having a proximal end and a distal end, the handle tapering from the proximal end to the distal end;

an adhesive roll, said adhesive roll having a cylindrical core;

a roller support section having a proximal end and a distal end, the roller support section being in substantial axial alignment with the proximal end of the handle, the roller support section including circumferential rings, the circumferential rings defining a circumference for a contact area that engages and supports the cylindrical core of the adhesive roll wherein the proximal end of the handle is only attached to the proximal end of the roller support section;

a case arranged to fit over the roller support section and adhesive roll, and onto the handle, and securing means for securing the case to the handle, the securing means being located on the proximal end of the handle, and the securing means defining a flush fit between the case and the handle at the proximal end of the handle.

2. The lint roller of claim 1 wherein the case is arranged to slide over the roller support section.

3. The lint roller of claim 1 whereby said adhesive roll is tubular.

4. The lint roller of claim 1 wherein the adhesive roll further comprises a number of adhesive sheets wound on the core.

5. The lint roller of claim 1 wherein the adhesive roll further comprises a flexible washable plastic substrate of polyvinyl.

6. The lint roller of claim 1 wherein the handle further comprises a lip.

7. The lint roller of claim 6 wherein the case further comprises an outer edge.

8. The lint roller of claim 7 wherein the lip has the same cross-section as the outer edge.

9. The lint roller of claim 1 wherein the case is substantially vertically free-standing.

* * * * *

UNITED STATES PATENT AND TRADEMARK OFFICE

CERTIFICATE OF CORRECTION

PATENT NO. : 7,114,213 B2
APPLICATION NO. : 10/911829
DATED : October 3, 2006
INVENTOR(S) : Flavio DeRoma It is certified that error appears in the above-identified patent and that said Letters Patent is hereby corrected as shown below:

Title Page,
Assignee is not listed in the patent.

Please Add Item (73)
Assignee: Kaminstein Imports, Inc.
Blauvelt, New York 10913

Signed and Sealed this

Twenty-first Day of August, 2007

JON W. DUDAS
*Director of the United States Patent and Trademark Office*